United States Patent [19]

Tiemann

[11] 4,443,916

[45] Apr. 24, 1984

[54] LATCHING DEVICES

[76] Inventor: James P. Tiemann, 64 Central St., Huntington, N.Y. 11743

[21] Appl. No.: 325,856

[22] Filed: Nov. 30, 1981

[51] Int. Cl.[3] ..... A44B 11/25

[52] U.S. Cl. ..... 24/664; 24/323

[58] Field of Search ..... 24/178, 179, 192, 230 R, 24/230 A, 230 AK, 230 AL

[56] References Cited

U.S. PATENT DOCUMENTS

| | | | |
|---|---|---|---|
| 941,542 | 11/1909 | Simpson | 24/230 R |
| 1,228,256 | 5/1917 | Stoll | 24/230 R |
| 2,882,581 | 4/1959 | Spielman . | |
| 3,200,464 | 8/1965 | Cousins . | |
| 3,570,073 | 3/1971 | Cibie | 24/230 R |
| 3,798,711 | 3/1974 | Cousins | 24/196 X |
| 3,844,000 | 10/1974 | Hedu . | |
| 3,967,351 | 7/1976 | Rosenberg et al. | 24/230 R |

FOREIGN PATENT DOCUMENTS

| | | | |
|---|---|---|---|
| 2464663 | 4/1981 | France | 24/230 A |

*Primary Examiner*—Robert P. Swiatek

*Attorney, Agent, or Firm*—Charles A. Blank

[57] ABSTRACT

The latching device includes a tongue unit engageable with a clasping unit having a pair of divergable leaf members. The leaf members are held in superposed relationship by a clip member that extends from one leaf member to the other. An elastomeric or spring washer disposed on the clip member helps maintain the tongue unit and clasping unit in locking engagement. The locking engagement of the tongue unit and clasping unit is accomplished by establishing interference between a catch surface on one of the units and an abutment surface on the other unit. Release of the latching device is obtained when the leaf members of the latching unit are diverged against the influence of the elastomeric or spring washer to bring the abutment surface and the catch surface out of interference with each other thereby permitting withdrawal of the tongue unit from the clasping unit.

27 Claims, 13 Drawing Figures

LATCHING DEVICES

This invention is directed to fastening devices and more particularly to a novel construction for a quick-engagement, quick-release latching device.

Latching devices comprising separate male and female members that can be repetitively latched and unlatched are well known in the art, such as disclosed in U.S. Pat. No. 3,200,464. Devices of this type usually require a simple manipulation of one or both of the latching members to accomplish the latching and unlatching operations.

Because latching devices of this type can be easily latched and unlatched they are readily adaptable for use in seat belts, as disclosed in U.S. Pat. No. 2,882,581, and in wearing apparel and jewelry, as disclosed in U.S. Pat. Nos. 3,844,000 and 3,798,711. Additional factors which contribute to the desirability of a particular latching device are the ease with which it can be manufactured, the economy of its manufacture and assembly and its ability to function when formed of different materials, as where one material, such as metal is preferable for one use, whereas another material such as plastic, is preferable for another use.

The latching devices shown in U.S. Pat. Nos. 3,200,464, 3,798,711 and 3,844,000 each require a deflectable element on the male member that deflects from its normal position in one instance to permit engagement with female member and then deflects back to its normal position upon such engagement to lock against the female member thereby preventing disengagement. Unlatching of the male member from the female member is accomplished by moving the deflectable element away from its normal position to give it clearance from the female member. The prior art devices with deflectable elements are generally formed of a plastic material and require rather complex molding techniques for their manufacture. Moreover a metallic equivalent of this type of latching device would be economically impractical to produce except in extremely large quantities.

The buckle disclosed in U.S. Pat. No. 2,882,581 requires a specially molded buckle housing and release button along with several other parts to form a relatively complex buckle assembly.

It is thus desirable to provide a latching device which is of simple construction, has a minimum number of parts, is easily formed of metal or plastic materials, and is economical to produce.

Among the several objects of the present invention may be noted the provision of a novel latching device, a novel construction for a latching device that employs a minimum number of parts, a novel latching device that is adaptable for construction from either metallic or plastic components, and a novel construction for a latching device that can be economically produced in metal or plastic. Other objects and features will be in part apparent and in part pointed out hereinafter.

The present invention relates to a novel latching device having mating parts that can be quickly engaged and/or quickly released by a simple manipulation of said device.

In accordance with the invention the latching device comprises a clasping unit and a tongue unit engageable with each other to form an interlocking assembly. The clasping unit includes a pair of leaf members that are superposed one over the other and arranged to diverge to receive the tongue unit. Joining means on the clasping unit join the leaf members together, and a resilient means included in the clasping unit opposes diverging movement of the leaf members when the tongue unit and the clasping unit are engaged. Locking engagement between the tongue unit and clasping unit is accomplished by interference between an abutment surface on one of the units and a catch surface on the other unit to prevent removal of the tongue unit from the clasping unit when the tongue unit is in a predetermined insertion position within the clasping unit.

In one embodiment of the invention the abutment surface is provided on one of the leaf members of the clasping unit and the catch surface is provided on the tongue unit. In another embodiment of the invention the abutment surface is provided on the tongue unit and the catch surface is provided on either one of the leaf members of the clasping unit.

The joining means that joins the leaf members of the clasping unit together includes a clip member having a head portion at one end and a securing member at the other end, with the leaf members sandwiched between the head portion and the securing member. The resilient means is disposed between the head portion and its corresponding leaf member and in further embodiments of the invention can be disposed between the securing member and its corresponding leaf member.

In a still further embodiment of the invention the joining means is formed as an integral extension of one of the leaf members for affixation to the other leaf member of the clasping unit, and the resilient means is an integral part of at least one leaf member.

Either the tongue member or the clasping unit can be formed of metal or plastic, or both of the units can be formed of plastic material.

The invention accordingly comprises the constructions hereinafter described, the scope of the invention being indicated in the following claims.

In the accompanying drawings in which various embodiments of the invention are illustrated, FIG. 1 is a perspective view of the latching device, in disengaged condition, incorporating one embodiment of the present invention;

Corresponding reference numbers indicate corresponding parts throughout the several views of the drawings.

Figure 1:
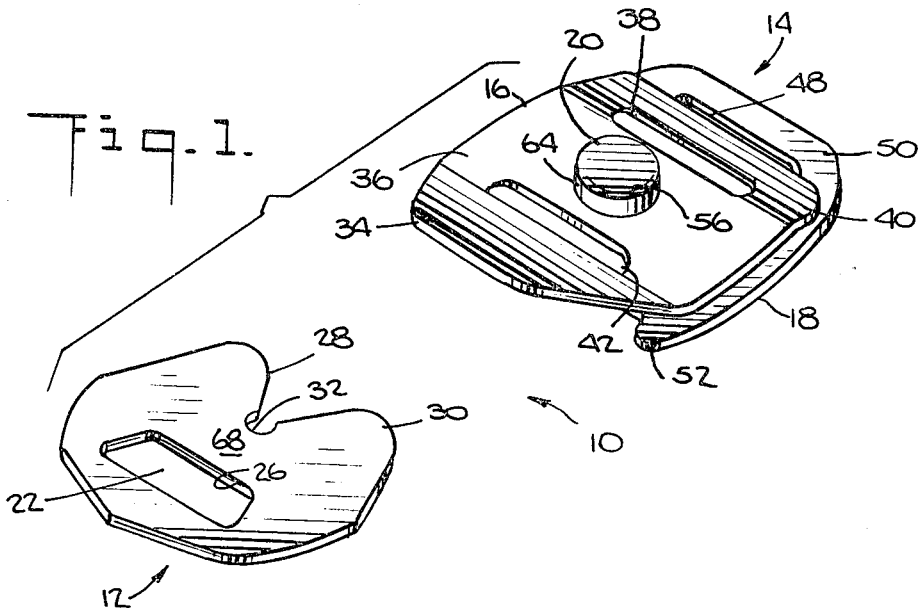

Referring now to the drawings, a latching device incorporating one embodiment of the invention is generally indicated by the reference number 10 in FIG. 1.

The latching device 10 comprises a tongue unit 12 and a clasping unit 14. Unless otherwise indicated, the components of the latching device 10 are formed of any suitable material such as aluminum.

Figure 2:
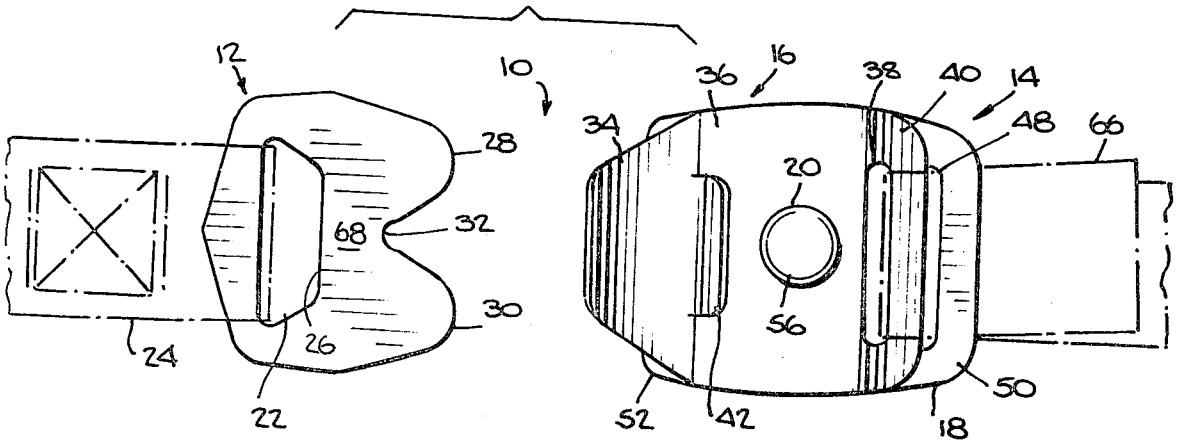
FIG. 2 is a plan view thereof.

The tongue unit 12 is substantially flat and includes a transverse elongated opening 22 which accommodates a belt-like material 24, shown in dotted outline in FIG. 2, for example. The opening 22 is bordered at one side by a forward edge or catch surface 26. A pair of cam surfaces 28 and 30 formed at the forward end of the tongue unit 12 converge to form a stop surface 32.

Figure 3:
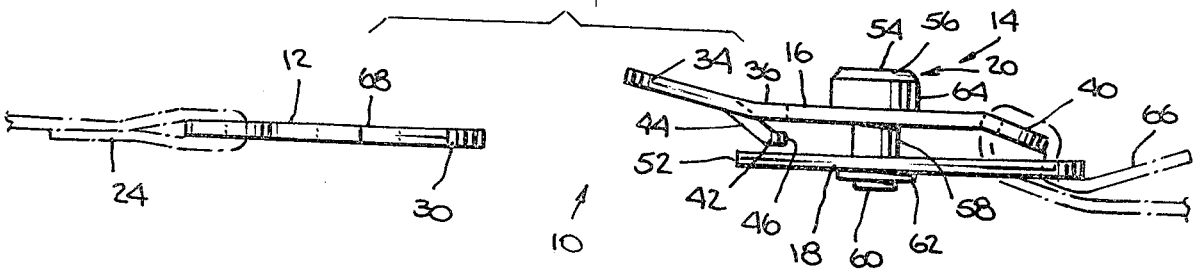
FIG. 3 is a side view thereof.
Figure 4:
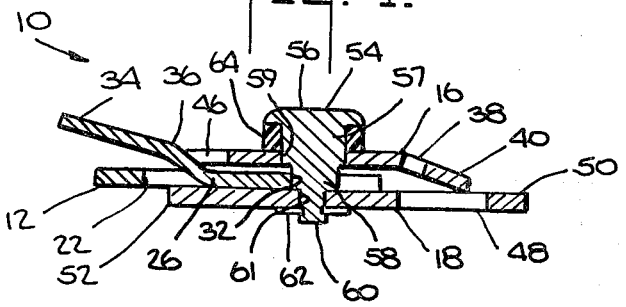
FIG. 4 is a sectional view thereof in an engaged condition.

The clasping unit 14 includes first and second leaf members 16 and 18 respectively held in superposed relationship by a joining means 20. The leaf member 16 includes a tabular extension 34 formed at an end portion 36. A transverse elongated slot 38 is formed at an opposite end portion 40, which end portion 40 has a bend directed downwardly toward the leaf member 18 as seen in FIGS. 3 and 4, for example. A projecting portion 42 formed in the leaf member 16, projects downwardly toward the leaf member 18 as shown in FIG. 3 for example. The projection 42 is inclined as indicated at 44 from the end portion 36 toward the end portion 40 of the leaf member 16. An elongated transverse edge 46 of the projection 42 is defined as an abutment surface.

The leaf member 18, which is substantially flat and of generally rectangular configuration, includes a transverse elongated opening 48 at an end portion 50 corresponding to the opening 38 of the leaf member 16. The leaf member 18 also includes an opposite end portion 52 corresponding to the end portion 36 of the leaf member 16.

The joining means 20 for holding the leaf members 16 and 18 in superposed relationship includes a clip member 54. As most clearly shown in FIG. 4, the clip member 54 passes through the leaf members 16 and 18 and includes a head portion 56 that extends above the leaf portion 16. The clip member 54 also includes a stem with three diametrical portions 57, 58 and 60 and a suitable securing means 62 such as a C-ring secured to the diametrical portion 60 below the leaf member 18. If desired the free end of the diametrical portion 60 can be staked or peened instead of using the securing means 62. A resilient biasing means such as an elastomeric washer 64 is provided between the head portion 56 and the leaf member 16.

The first diametrical portion 57 passes with clearance through an opening 59 in the leaf member 16 and has an extent approximately equivalent to the combined thickness of the washer 64 and the leaf member 16. The second diametrical portion 58 has an extent approximately equivalent to the spacing between the leaf members 16 and 18 and terminates above the leaf member 18. The third diametrical portion 60 passes with clearance through an opening 61 in the leaf member 18, which opening 61 is of lesser diameter than the diametrical portion 58. Thus the leaf member 18 is secured between the diametrical portion 58 and the securing means 62. A belt-like material 66, as shown dotted in FIGS. 2 and 3, is secured in any suitable known fashion to the leaf members 16 and 18 through the openings 38 and 48.

In using the latching device 10 the tongue unit 12 is aligned with the clasping unit 14 in a manner such as shown in FIG. 2. The tongue unit 12 is then inserted between the leaf members 16 and 18 by engaging the forward ends of the cam surfaces 28 and 30 against the inclined surface 44 of the projecting portion 42. Such engagement diverges the leaf members 16 and 18 until the projection 42 is shifted onto the surface 68 of the tongue unit 12. Consequently the elastomeric washer 64 is compressed between the head portion 56 of the clip member 54 and the leaf member 16. Such compression of the elastomeric washer 64 forces the leaf member 16 against the tongue unit 12.

The tongue unit 12 is inserted to a predetermined limit position intermediate the leaf members 16 and 18 wherein the stop surface 32 engages the diametrical portion 58 of the clip member 54. When the tongue unit 12 is close to, or at the insertion limit position, the catch surface 26 is located beyond the abutment surface 46 of the projecting portion 42. The projecting portion 42 thus descends into the opening 22 of the tongue unit 12 due to the force imposed on the leaf member 16 by the compressed washer 64. Accordingly the projection 42 is of a predetermined size and shape which can be accommodated by the opening 22. When the projection 42 is received in the opening 22 the elastomeric washer 64 expands a corresponding amount and is thus in a relatively uncompressed condition. However, the washer 64 can be maintained under some compression if a force is desired on the tongue unit 12 in its latched position.

Any attempt to withdraw the tongue unit 12 from the clasping unit 14 by pulling the tongue unit 12 in a direction opposite to that in which it was inserted into the clasping unit 12 will cause the catch surface 26 to interfere with the abutment surface 42. The tongue and clasping units 12 and 14 thus remain interlocked together despite any tension forces imposed on the belt portions 24 and 66. In order to unlock or unlatch the tongue unit 12 from the clasping unit 14 the interference between the abutment surface 42 and the catch surface 36 must be obviated. This is accomplished by lifting the tab portion 34 of the leaf member 16 in an upward direction with reference to FIG. 4 to diverge the leaf member 16 from the leaf member 18. During such movement of the leaf member 16, the leaf member 18 can be held steady by the tongue unit 12 as it is being withdrawn.

The divergence of the leaf member 16 with respect to the leaf member 18 is opposed by the elastomeric washer 64. The elastomeric washer 64 thus helps prevent disengagement of the tongue unit 12 from the clasping unit 10. Accordingly, the divergence of the leaf members 16 and 18 must be an amount sufficient to enable the projection 42 to clear the catch surface 26 of the tongue unit 12 so that the abutment surface 46 no longer interferes with the catch surface 26.

The lift up force needed to diverge the leaf member 16 from the leaf member 18 is a function of the resiliency of the elastomeric washer 64. The required force can thus be predetermined based on the specific material selected for the washer 64.

It should be noted that the tongue unit 12 cannot influence movement of the leaf member 16 because any attempt to diverge the tongue unit 12 from the leaf member 18 will cause the stop portion 32 to interfere with the diametrical portion 57 of the clip member 54. This interference is a safety feature which ensures that mere wobbling or other inadvertent movement of the tongue unit 12 will not cause the projection 42 to clear the catch surface 26. Therefore disengagement of the tongue unit 12 and the clasping unit 14 is substantially restricted to a consequence of tab 34 being lifted up to obtain the necessary divergence of the leaf members 16 and 18.

Figure 5:
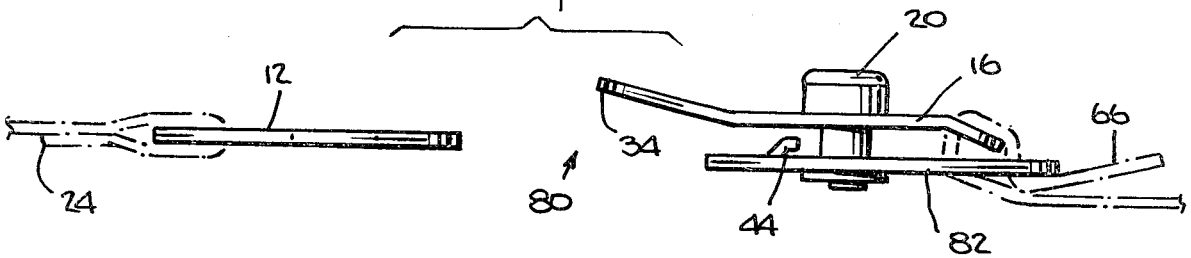
FIGS. 5 and 6 are side views of other embodiments of the invention.

A further embodiment of the latching device is generally indicated by the reference number 80 in FIG. 5. The latching device 80 differs from the latching device 10 by provision of the projecting portion 44 on a leaf member 82 corresponding to the leaf member 18. In all other respects the structure and operation of the latching device 80 is identical to that of the latching device 10.

Figure 6:
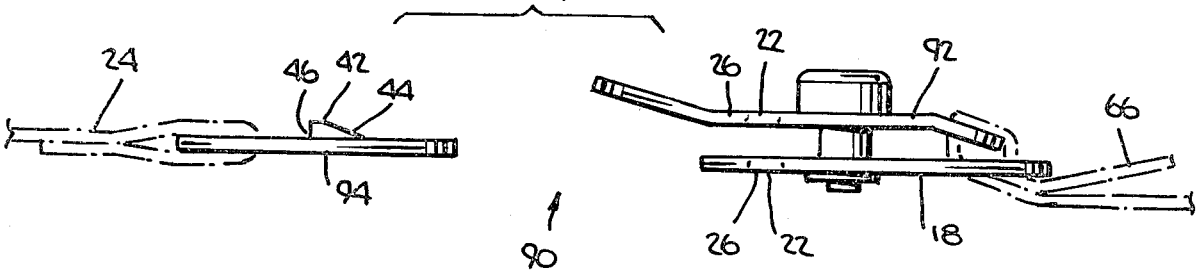

A still further embodiment of the latching device is generally indicated by the reference number 90 in FIG. 6. The latching device 90 differs from the latching device 10 by provision of the opening 22 on a leaf member 92 corresponding to the leaf member 16. The latching device 90 also includes a tongue unit 94 corresponding to the tongue unit 12 but formed with the projection 42. In all other respects the structure and operation of the latching device 90 is identical to that of the latching device 10 as previously described. If desired the opening 22 can be included in the leaf member 18 to permit functioning of the latching device in an obverse position of the tongue unit 94.

Figure 7:
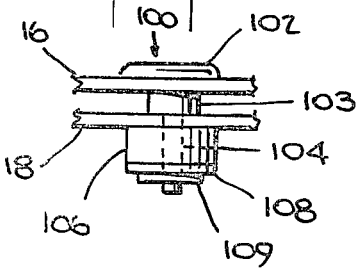
FIGS. 7, 8 and 9 are fragmentary views of other embodiments of the invention.
Figure 8:
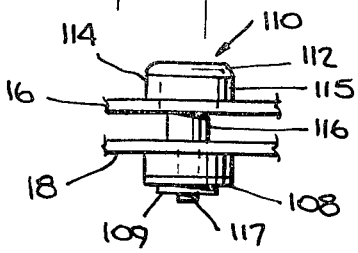
Figure 9:
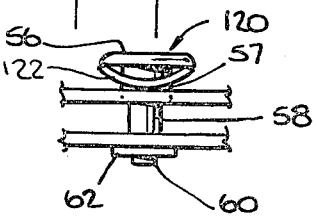

Further embodiments of the invention include joining means and resilient means such as shown in FIGS. 7, 8 and 9. For purposes of clarity the tongue unit and surrounding structure of the clasping unit have been omitted, but are otherwise similar to that of the latching device 10.

For example, FIG. 7 shows an embodiment of the latching device including a clip member 100 having a head portion 102 adjacent the leaf member 16. The clip member 100 also includes a diametrical portion 103 corresponding to the diametrical portion 58, extending from the head portion 102 through the leaf member 16 to the leaf member 18. A reduced diametrical portion 104 corresponding to the reduced diametrical portion 60 extends from the diametrical portion 103 through the leaf member 18. An elastomeric washer 106 identical to the washer 64 is sandwiched between a metal washer 108 and the leaf member 18. Any suitable securing means such as a C-ring 109 can be affixed to the reduced diametrical portion 104 below the washer 106. The latching device of this embodiment operates in a manner similar to the latching device 10.

FIG. 8 shows an embodiment of the latching device including a clip member 110 having a head portion 112. An elastomeric washer 114 is provided between the head portion 112 and the leaf member 16. The clip member 110 also includes a first diametrical portion 115 corresponding to the diametrical portion 57 of the clip member 54. The diametrical portion 115 has an extent approximately equivalent to the combined thickness of the washer 114 and the leaf member 16. A second diametrical portion 116, identical to the diametrical portion 58 of the clip member 54, terminates above the leaf member 18. A reduced diametrical portion 117 corresponding to the diametrical portion 60 of the clip member 54 extends from the diametrical portion 116 through the leaf member 18. An elastomeric washer 118 similar to the washer 114 is sandwiched between the leaf member 18 and a metallic washer 108. Securing means such as the C-ring 109 is attached to the diametrical portion 118 below the washer 108. The latching device of this embodiment operates in a manner similar to that described for the latching device 10.

FIG. 9 shows an embodiment of the latching device including a clip member 120 similar to the clip member 54. However, a resilient means such as a spring washer 122 of any suitable known construction is disposed between the head portion 56 and the leaf member 16 to provide a biasing force against the leaf member 16 when an attempt is made to diverge the leaf members 16 and 18. The latching device of this embodiment operates in a manner similar to that described for the latching device 10.

Figure 10:
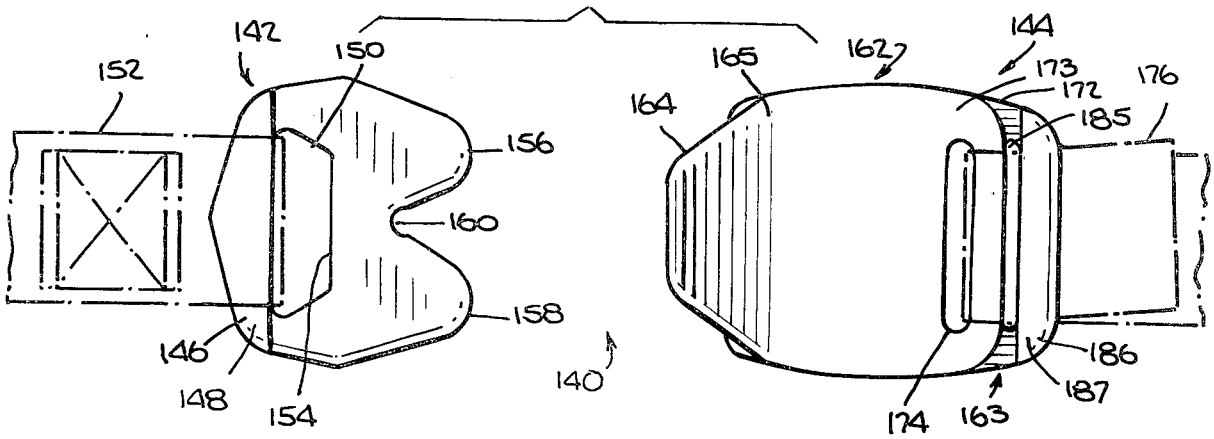
FIG. 10 is a plan view of a further embodiment of the invention, in disengaged condition.

A further embodiment of the latching device is generally indicated by the reference number 140 in FIG. 10. The latching device 140, unless otherwise indicated, is formed of any suitable known plastic material.

The latching device 140 includes a tongue unit 142 and a clasping unit 144. The characteristics of the tongue unit 142 substantially correspond with those of the tongue unit 12 except for a reinforcement section 146 at an end portion 148. The reinforcement section 148 is approximately twice as thick as other sections of the tongue unit. A transverse elongated opening 150 identical to the opening 22 accommodates a belt-like material 152 shown in dotted outline in FIG. 10. The opening 150 is bordered at one side by a forward edge or catch surface 154. A pair of cam surfaces 156 and 158 corresponding to the cam surfaces 28 and 30 are formed at the forward end of the tongue unit 142 and converge to form a stop surface 160.

Figure 11:
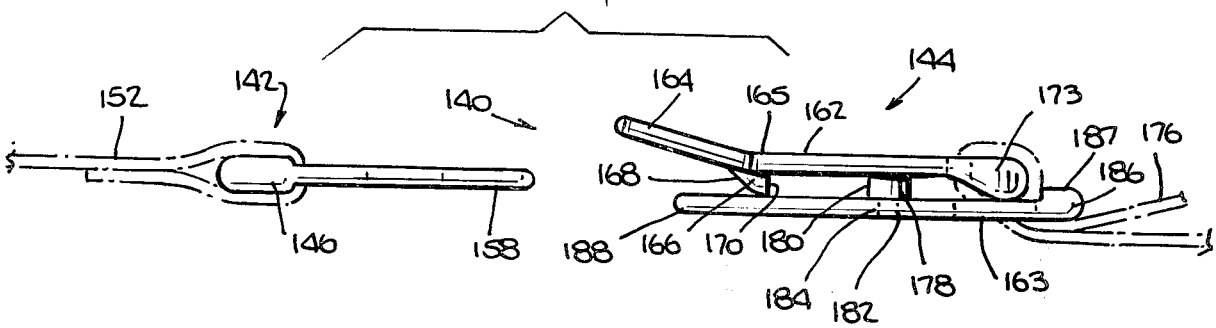
FIG. 11 is a side view thereof.
Figure 12:
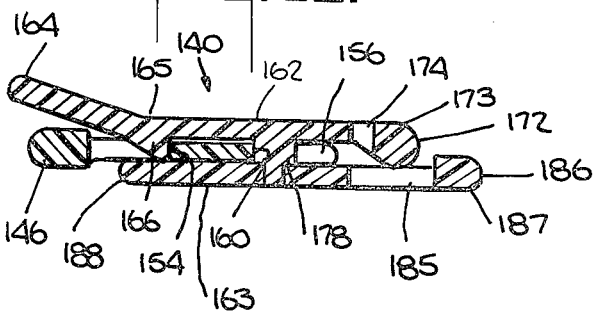
FIG. 12 is a sectional view thereof, in engaged condition.

The clasping unit 144 is comprised of first and second leaf members 162 and 163 respectively. The leaf member 162 of the clasping unit 144 includes a tabular extension 164 formed at an end portion 165 and is substantially identical to the tabular portion 34 of the latching device 10. A projection 166 is formed at the end portion 164 to project downwardly from the leaf member 162 towards the leaf member 163 as viewed in FIG. 11. The projection 166 has an inclined surface 168 and an abutment surface 170 analogous to the inclined surface 44 and the abutment surface 46 of the latching device 10. The leaf member 162 also includes an opposite end portion 172 having a reinforcement section 173 as shown in FIG. 11 and an elongated opening 174 for accommodation of a belt-like material 176 as shown in dotted lines in FIGS. 10 and 11.

The leaf member 162 also includes a joining member or link 178 projecting therefrom towards the leaf member 163. The joining member 178 has a first diametrical portion 180 extending between the leaf members 162 and 163, and a reduced diametrical portion 182 received in an opening 184 of corresponding size and shape in the leaf member 163. The leaf member 163 is secured to the reduced diametrical portion 182 in any suitable known manner for welding plastic material to prevent relative movement between the leaf member 163 and the reduced diametrical portion 182.

The leaf member 163 includes a slot 185 to accommodate the belt-like material 176 at an end portion 186, having a reinforcement section 187. The leaf member 163 also includes an opposite end portion 188.

In using the latching device 140, the tongue unit 142 is aligned with the clasping unit 144 in a manner such as previously described with respect to the latching device 10. The plastic material selected for the latching device 140 is of a type that is sufficiently resilient to permit divergence of the end portions 165 and 188 of the respective leaf members 162 and 163 when the tongue unit 142 is inserted into the clasping unit 144 in a manner similar to that previously described with respect to the latching device 10. The deflectability of the leaf members 162 and 163 can be further enhanced in accordance with ordinary skills of the art. For example the sectional area of the leaf members can be reduced at predetermined locations such as at 190 and 192 (FIG. 13) in a manner which will not unduly concentrate stresses in such areas.

Figure 13:
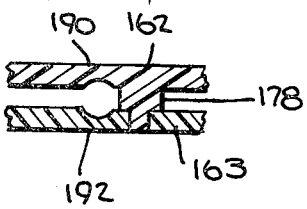
FIG. 13 is an enlarged fragmentary sectional view thereof.

Once the tongue unit 142 has been inserted in the clasping unit 144 to a predetermined position the abutment surface 170 will interfere with the catch surface 154 to prevent withdrawal of such tongue unit. The interference between the abutment surface 170 and the catch surface 154 can be obviated by lifting the tab portion 164 to diverge the end portions 165 and 188, and obtain clearance between the abutment surface 170 and the catch surface 154. The lifting force required to diverge the end portions 165 and 188 an amount sufficient to provide the required clearance is a function of the elasticity of the leaf members 146 and 148, and of any provision for reduced sectional areas such as shown in FIG. 13.

As will be apparent to those skilled in the art a plastic component of one embodiment of the invention can be substituted for a metal component of another embodiment thereof and vice versa.

Some advantages of the present invention evident from the foregoing description include a latching device which can be constructed from a relatively small number of parts to provide for quick-engagement and quick-release of the latching components. Manipulation of the tongue unit and clasping unit to engage and disengage the latching device is relatively easy to accomplish and requires no special skill or unusual strength. The latching device can be simply made using conventional manufacturing procedures, is easily assembled, and thus economical to produce. Furthermore, because of the relatively simple construction yet very effective latching action, the latching device can be adapted to numerous fields of use ranging from heavy duty use in packaging and safety devices to garments and other light duty uses.

In view of the above, it will be seen that the several objects of the invention are achieved and other advantageous results attained.

As various changes can be made in the above constructions without departing from the scope of the invention it is intended that all matter contained in the above description or shown in the accompanying drawings should be interpreted as illustrative and not in a limiting sense.

What is claimed is:

1. A quick-engagement, quick-release latching device comprising a clasping unit and a tongue unit, engageable with said clasping unit, latching means provided on said clasping unit and said tongue unit to interlock said tongue unit and said clasping unit, said clasping unit including only two non-resilient leaf members superposed one over the other and being relatively divergent, said tongue unit being receivable between the leaf members upon divergence thereof, into a predetermined insertion position to permit engagement of said latching means, and joining means extending from one of said leaf members to the other said leaf member for joining said leaf members in said superposed relationship, said clasping unit further including resilient means for opposing divergent movement of said leaf members, said one leaf member being a lift-to-release member, said tongue unit being releasable from said predetermined insertion position upon lifting said one leaf member for diverging said leaf members a predetermined amount in opposition to said resilient means to permit disengagement of said latching means.

2. A latching device as claimed in claim 1 wherein said latching means comprise an abutment surface provided on one of said units and a catch surface provided on the other of said units for abutting interference to prevent removal of said tongue unit from said clasping unit when said tongue unit is in said predetermined position.

3. A latching device as claimed in claim 2 wherein said abutment surface is formed as part of said one leaf member and is substantially immovable with respect to said one leaf member.

4. A latching device as claimed in claim 3 wherein said one leaf member includes a projection, projecting towards said other leaf member and said abutment surface is formed on said projection.

5. A latching device as claimed in claim 4 wherein said tongue unit includes an opening and said catch surface is formed at an edge of said opening, said opening accommodating said projection to permit interference of said abutment surface with said catch surface when said tongue unit is in said predetermined insertion position.

6. A latching device as claimed in claim 4 wherein said projection is inclined away from one end portion of said one leaf member toward an opposite end portion of said one leaf member to facilitate disposition of said tongue unit into said predetermined insertion position.

7. A latching device as claimed in claim 2 wherein said abutment surface is formed as part of said other leaf member and is substantially immovable with respect to said other leaf member.

8. A latching device as claimed in claim 7 wherein said other leaf member includes a projection, projecting toward said one leaf member and said abutment surface is formed on said projection.

9. A latching device as claimed in claim 8 wherein said tongue unit includes an opening and said catch surface is formed at an edge of said opening, said opening accommodating said projection to permit interference of said abutment surface with said catch surface when said tongue unit is in said predetermined position.

10. A latching device as claimed in claim 8 wherein said projection is inclined away from one end portion of said one leaf member toward an opposite end portion of said one leaf member to facilitate disposition of said tongue unit into said predetermined insertion position.

11. A latching device as claimed in claim 2 wherein said abutment surface is formed as part of said tongue unit and is substantially immovable with respect to said tongue unit.

12. A latching device as claimed in claim 11 wherein said tongue unit includes a projection, and said abutment surface is formed on said projection.

13. A latching device as claimed in claim 12 wherein said one leaf member includes an opening and said catch surface is formed at an edge of said opening, said opening accommodating said projection to permit interference of said abutment surface with said catch surface when said tongue unit is in said predetermined insertion position.

14. A latching device as claimed in claim 12 wherein said other leaf member includes an opening and said catch surface is formed at an edge of said opening, said opening accommodating said projection to permit interference of said abutment surface with said catch surface when said tongue unit is in said predetermined insertion position.

15. A latching device as claimed in claim 1 wherein said joining means comprise a clip member having a stem portion extending through said one of said leaf members to said other leaf member.

16. A latching device as claimed in claim 15 wherein said clip member includes a head portion spaced from said one leaf member, said resilient means being disposed between and against said head portion and said one leaf member.

17. A latching device as claimed in claim 16 wherein said resilient means comprise an elastomeric material.

18. A latching device as claimed in claim 16 wherein said resilient means comprise a metallic spring-like material.

19. A latching device as claimed in claim 15 wherein said stem portion has a first diametrical dimension extending between said leaf members and a reduced diametrical dimension smaller than said first diametrical dimension extending through said other leaf member, said device further including holding means at said reduced diametrical portion to prevent movement of said other leaf member with respect to said clip member.

20. A latching device as claimed in claim 19 wherein the stem portion of said clip member extends through and projects beyond said other leaf member.

21. A latching device as claimed in claim 20 wherein said resilient means is provided at the reduced diametrical portion of said clip member, said device further including holding means at the projecting part of said reduced diametrical portion for locating said resilient means between said holding means and said other leaf member.

22. A latching device as claimed in claim 21 wherein said resilient means comprise an elastomeric material.

23. A latching device as claimed in claim 1 wherein said tongue unit is insertable between said leaf members and includes a cam surface engageable with said joining means to locate said tongue unit in said predetermined insertion position.

24. A latching device as claimed in claim 23 wherein said cam surface includes a stop portion for abutment against said joining means to limit insertion of said tongue unit between said leaf members to said predetermined insertion position.

25. A latching device as claimed in claim 23 wherein said joining means comprise a clip member having a stem portion extending through said one of said leaf members to said other leaf member, said one leaf member being movable along the extent of said clip member, said stem portion having a first diametrical dimension that interferes with the stop portion of said tongue unit to substantially prevent movement of said tongue unit along the extent of said clip member having said first diametrical dimension.

26. A latching device as claimed in claim 1 wherein said clasping unit includes a manually actuatable tab portion for diverging movement of one of said leaf members.

27. A latching device as claimed in claim 26 wherein said tab portion is formed as an endwise extension of said one leaf member.

* * * * *